US007663455B2

(12) United States Patent
Goi et al.

(10) Patent No.: US 7,663,455 B2
(45) Date of Patent: Feb. 16, 2010

(54) BAND-PASS FILTER ELEMENT AND HIGH FREQUENCY MODULE

(75) Inventors: Tomoyuki Goi, Tokyo (JP); Hideaki Fujioka, Tokyo (JP); Masami Itakura, Tokyo (JP); Hideya Matsubara, Tokyo (JP)

(73) Assignee: TDK Corporation, Tokyo (JP)

( * ) Notice: Subject to any disclaimer, the term of this patent is extended or adjusted under 35 U.S.C. 154(b) by 165 days.

(21) Appl. No.: 11/783,718

(22) Filed: Apr. 11, 2007

(65) Prior Publication Data

US 2007/0262833 A1 Nov. 15, 2007

(30) Foreign Application Priority Data

May 10, 2006 (JP) ..... 2006-130984

(51) Int. Cl.
*H01P 3/08* (2006.01)

(52) U.S. Cl. ..... 333/204; 333/128; 333/134; 333/246; 333/247

(58) Field of Classification Search ..... 333/126, 333/128, 134, 204, 205, 246, 247
See application file for complete search history.

(56) References Cited

U.S. PATENT DOCUMENTS

| | | | | |
|---|---|---|---|---|
| 5,304,967 | A | 4/1994 | Hayashi | |
| 6,252,778 | B1 * | 6/2001 | Tonegawa et al. | 361/761 |
| 6,401,328 | B1 | 6/2002 | Matsumoto et al. | |
| 6,456,172 | B1 | 9/2002 | Ishizaki et al. | |
| 6,784,759 | B2 * | 8/2004 | Maekawa et al. | 333/132 |
| 6,971,162 | B2 * | 12/2005 | Estes et al. | 29/832 |
| 7,236,070 | B2 * | 6/2007 | Ajioka et al. | 333/247 |
| 7,242,268 | B2 | 7/2007 | Hagiwara et al. | |
| 2003/0085780 | A1 | 5/2003 | Wang | |
| 2004/0066617 | A1 | 4/2004 | Hirabayashi et al. | |
| 2004/0246072 | A1 | 12/2004 | Hidaka et al. | |

FOREIGN PATENT DOCUMENTS

| | | |
|---|---|---|
| EP | 1 548 872 A1 | 6/2005 |
| JP | A-04-355902 | 12/1992 |
| JP | A 05-145308 | 6/1993 |
| JP | A 05-152803 | 6/1993 |
| JP | A 09-205306 | 8/1997 |
| JP | A-10-209707 | 8/1998 |
| JP | A 10-303068 | 11/1998 |
| JP | A-11-097963 | 4/1999 |

(Continued)

*Primary Examiner*—Robert Pascal
*Assistant Examiner*—Kimberly E Glenn
(74) *Attorney, Agent, or Firm*—Oliff & Berridge, PLC

(57) ABSTRACT

A high frequency module incorporates a layered substrate, a plurality of elements mounted on a top surface of the layered substrate, and a metallic casing that covers these elements. The plurality of elements mounted on the top surface of the layered substrate include a band-pass filter element. The band-pass filter element includes a plurality of conductor layers for band-pass filter and a plurality of dielectric layers for band-pass filter that implement a function of a band-pass filter, but does not include any conductor layer that functions as an electromagnetic shield. A conductor layer for grounding that the layered substrate includes and the casing are each opposed to the band-pass filter element, and thereby function as an electromagnetic shield for the band-pass filter element.

2 Claims, 8 Drawing Sheets

FOREIGN PATENT DOCUMENTS

| | | |
|---|---|---|
| JP | A 2004-040322 | 2/2004 |
| JP | A-2004-064606 | 2/2004 |
| JP | A-2004-153581 | 5/2004 |
| JP | A-2004-166258 | 6/2004 |
| JP | A-2005-020154 | 1/2005 |
| JP | A-2005-341319 | 12/2005 |

* cited by examiner

BAND-PASS FILTER ELEMENT AND HIGH FREQUENCY MODULE

BACKGROUND OF THE INVENTION

1. Field of the Invention

The present invention relates to a band-pass filter element and to a high frequency module incorporating the band-pass filter element and a layered substrate.

2. Description of the Related Art

Recently, cellular phones operable in a plurality of frequency bands (multibands) have been put to practical use. The third-generation cellular phones having a high-rate data communication function have also been widely used. It is therefore required that cellular phones be operable in multiple modes and multiple bands.

For example, cellular phones that conform to the time division multiple access system and that are operable in multibands have been practically utilized while cellular phones that conform to the wide-band code division multiple access (WCDMA) system have been practically utilized, too. To make communications through the WCDMA system accessible while making the most of the existing infrastructure of the time division multiple access system, it is required to provide cellular phones that have communication functions for both systems and that are operable in multiple modes and multibands.

For example, JP 2004-040322A discloses a front end section that performs input/output of signals of the WCDMA system and input/output of signals of three time division multiple access systems, that is, the global system for mobile communications (GSM), the digital cellular system (DCS) and the personal communications service (PCS).

A smaller size and higher integration are required for the front end part of the front end section of a cellular phone typically has the form of a module. Such a module is called a front end module. A front end module including a switch circuit for switching signals is also called an antenna switch module. In the present patent application, a combination of circuits performing processing of high frequency signals and a substrate for integrating these circuits, including such a front end module, is called a high frequency module. As the substrate in a high frequency module, a layered substrate including a plurality of dielectric layers and a plurality of conductor layers alternately stacked is used, for example.

In the front end section that performs input/output of signals of the WCDMA system and input/output of signals of a plurality of time division multiple access systems as disclosed in JP 2004-040322A, a band-pass filter (BPF) is required for selectively allowing WCDMA reception signals to pass. A BPF that selectively allows WCDMA reception signals to pass will be hereinafter called a WCDMA reception BPF. It is required that the WCDMA reception BPF have performance capabilities that achieve a low power loss and a high resistance to power. A block-type dielectric filter is known as a BPF that satisfies such requirements. However, the block-type dielectric filter is relatively large in dimensions. Consequently, if the block-type dielectric filter and a front end module are mounted as individual components on a substrate of a cellular phone, a large area is occupied by the block-type dielectric filter and it is therefore difficult to achieve smaller dimensions and higher integration of the front end section. To solve this problem, it is possible to mount the block-type dielectric filter on the substrate of the front end module and to thereby include the block-type dielectric filter in the front end module. For this purpose, it is required to reduce the thickness of the block-type dielectric filter. However, it is difficult to reduce the thickness of the block-type dielectric filter because of the operational principle. Therefore, it is also difficult to include the block-type dielectric filter in the front end module.

In the front end section disclosed in JP 2004-040322A, the WCDMA reception BPF and a switch for switching signals other than WCDMA reception signals are respectively connected to an antenna through a phase line so as to allow the front end section to be capable of receiving WCDMA reception signals at all times. The phase line adjusts the impedance of each of the path from the antenna to the WCDMA reception BPF and the path from the antenna to the switch, and thereby separates WCDMA reception signals from other signals. The following problem occurs in the case where, in such a configuration, the WCDMA reception BPF and the front end module are mounted as individual components on the substrate of a cellular phone. In this case, it is required to provide a phase line on the substrate of the cellular phone for adjusting the impedance of the path from the antenna to the WCDMA reception BPF and to adjust the characteristic of the front end section by this phase line. However, this adjustment is difficult. If it is possible to include the WCDMA reception BPF in the front end module, it is made possible to adjust the characteristic of the front end section only by the phase line in the front end module and it is therefore easy to adjust the characteristic. However, as previously described, it is difficult to include the WCDMA reception BPF in the front end module in the case in which a block-type dielectric filter is used as the WCDMA reception BPF.

A surface acoustic filter is known as a filter that can be reduced in size and thickness. However, since the surface acoustic filter has a low resistance to power, it is not suitable for use as a WCDMA reception BPF in the front end section that is capable of receiving WCDMA reception signals at all times and that has such a possibility that a high-power GSM transmission signal passes through the WCDMA reception BPF, as disclosed in JP 2004-040322A.

Furthermore, as disclosed in JP 10-303068A, for example, a layered BPF employing a resonator made of a conductor layer sandwiched between dielectric layers. The BPF disclosed in this publication has such a structure that a resonator electrode is sandwiched between two high-permittivity layers, and two low-permittivity layers are respectively disposed on both sides of the two high-permittivity layers in the direction in which the layers are stacked. A shield electrode is disposed between each of the high-permittivity layers and each of the low-permittivity layers.

JP 5-145308A discloses a dielectric resonator having such a structure that a resonant conductor is sandwiched between two high-dielectric layers, two low-dielectric layers are respectively disposed on both sides of the two high-dielectric layers in the direction in which the layers are stacked, and furthermore, ground (GND) electrodes are respectively disposed on both sides of the two low-dielectric layers in the direction in which the layers are stacked.

JP 5-152803A discloses a dielectric filter having a structure similar to that of the dielectric resonator disclosed in JP 5-145308A.

JP 9-205306A discloses a micro-wave circuit element having such a structure that quarter-wave strip lines are respectively provided on both surfaces of a center dielectric material, two inner dielectric materials are respectively disposed on both sides of the center dielectric material in the direction in which the layers are stacked, two outer dielectric materials are respectively disposed on both sides of the two inner dielectric materials in the direction in which the layers are stacked, and ground electrodes are further disposed respectively on both sides of the two outer dielectric materials in the direction in which the layers are stacked.

An electromagnetic shield is required for a layered BPF to prevent influences of external electromagnetic fields. The shield electrode of JP 10-303068A, the ground electrodes of JP 5-145308A and JP 5-152803A , and the ground electrode of JP 9-205306A each have the function of a shield.

For a layered BPF, it is effective to dispose a high-permittivity layer around a resonator to achieve a reduction in size. A high-permittivity layer is disposed around the center conductor in the structure disclosed in each of JP 5-145308A, JP 5-152803A and JP 9-205306A, too.

In the front end section performing input/output of signals of the WCDMA system and input/output of signals of a plurality of time division multiple access systems, it is possible to employ the above-mentioned layered BPF as the WCDMA reception BPF. However, the following problem occurs in this case. As previously described, a shield is required for the layered BPF. In addition, it is effective for the layered BPF to dispose a high-permittivity layer around a resonator to achieve a reduction in size, as previously described. In the layered BPF having such a structure, since the high-permittivity layer is disposed between the resonator and the shield, it is likely that a high capacitance is generated between the resonator and the shield. As a result, the Q of the resonator is likely to decrease, as disclosed in JP 5-145308A. To prevent this, it is required to increase the distance between the resonator and the shield. However, this increase in distance leads to an increase in thickness of the entire layered BPF, and if this layered BPF is mounted on a substrate, the thickness of the entire layered structure including the substrate and the BPF is increased. It is therefore difficult to downsize the front end section.

OBJECT AND SUMMARY OF THE INVENTION

It is a first object of the invention to provide a band-pass filter element that is to be mounted on a layered substrate and that is capable of reducing the thickness of an entire layered structure including the layered substrate and the band-pass filter element.

It is a second object of the invention to provide a high frequency module incorporating a layered substrate and a band-pass filter element mounted on the layered substrate, the high frequency module being capable of reducing the thickness of an entire layered structure including the layered substrate and the band-pass filter element.

A band-pass filter element of the invention is an element to be mounted on a layered substrate, the layered substrate incorporating: a plurality of intra-substrate conductor layers including a conductor layer for grounding that is to be connected to the ground; and a plurality of intra-substrate dielectric layers, the intra-substrate dielectric layers and the intra-substrate conductor layers being alternately stacked. The band-pass filter element of the invention includes conductor layers for band-pass filter and dielectric layers for band-pass filter that are stacked and that implement a function of a band-pass filter, but does not include any conductor layer that functions as an electromagnetic shield. The band-pass filter element of the invention is to be mounted on the layered substrate such that the conductor layer for grounding that the layered substrate includes is opposed to the band-pass filter element and thereby functions as an electromagnetic shield for the band-pass filter element.

The band-pass filter element of the invention does not include any conductor layer that functions as an electromagnetic shield. However, when the band-pass filter element is mounted on the layered substrate, the conductor layer for grounding that the layered substrate includes is opposed to the band-pass filter element and functions as an electromagnetic shield for the band-pass filter element.

In the band-pass filter element of the invention, the conductor layers for band-pass filter include a conductor layer that constitutes a resonator.

A high frequency module of the invention incorporates a layered substrate and a band-pass filter element mounted on the layered substrate. The layered substrate incorporates: a mounting surface on which the band-pass filter element is mounted; a plurality of intra-substrate conductor layers; and a plurality of intra-substrate dielectric layers, the intra-substrate dielectric layers and the intra-substrate conductor layers being alternately stacked. The band-pass filter element includes conductor layers for band-pass filter and dielectric layers for band-pass filter that are stacked and that implement a function of a band-pass filter. The layered substrate includes, as one of the intra-substrate conductor layers, a conductor layer that is located to be opposed to the band-pass filter element with the mounting surface disposed in between and that functions as an electromagnetic shield for the band-pass filter element.

In the high frequency module of the invention, the layered substrate includes the conductor layer that functions as an electromagnetic shield for the band-pass filter element. In the high frequency module of the invention, it is not necessary that the band-pass filter element include the conductor layer that functions as an electromagnetic shield.

In the high frequency module of the invention, the conductor layers for band-pass filter may include a conductor layer that constitutes a resonator.

The high frequency module of the invention may further incorporate a metallic casing that is disposed to cover the band-pass filter element and that functions as an electromagnetic shield for the band-pass filter element.

In the high frequency module of the invention, the dielectric layers for band-pass filter may have a permittivity higher than that of the intra-substrate dielectric layers.

In the high frequency module of the invention, the layered substrate may include a circuit formed using the intra-substrate conductor layers, and the conductor layer that functions as the electromagnetic shield may also function as a ground of the circuit.

In the high frequency module of the invention, the mounting surface may include a recessed portion, and the band-pass filter element may be placed in the recessed portion.

The band-pass filter element of the invention does not include any conductor layer that functions as an electromagnetic shield. However, when the band-pass filter element is mounted on the layered substrate, the conductor layer for grounding that the layered substrate includes is opposed to the band-pass filter element, and thereby functions as an electromagnetic shield for the band-pass filter element. Since the band-pass filter element of the invention does not include any conductor layer that functions as an electromagnetic shield, it is possible to make the thickness thereof smaller, compared with a case in which the band-pass filter element includes a conductor layer that functions as an electromagnetic shield. As a result, the invention makes it possible to reduce the thickness of the entire layered structure including the layered substrate and the band-pass filter element.

In the high frequency module of the invention, since the layered substrate includes the conductor layer that functions as an electromagnetic shield for the band-pass filter element, it is not necessary that the band-pass filter element include a conductor layer that functions as an electromagnetic shield.

As a result, according to the invention, it is possible to reduce the thickness of the band-pass filter element, and it is thereby possible to reduce the thickness of the entire layered structure including the layered substrate and the band-pass filter element:

Other and further objects, features and advantages of the invention will appear more fully from the following description.

DESCRIPTION OF PREFERRED EMBODIMENTS

First Embodiment

Figure 1:
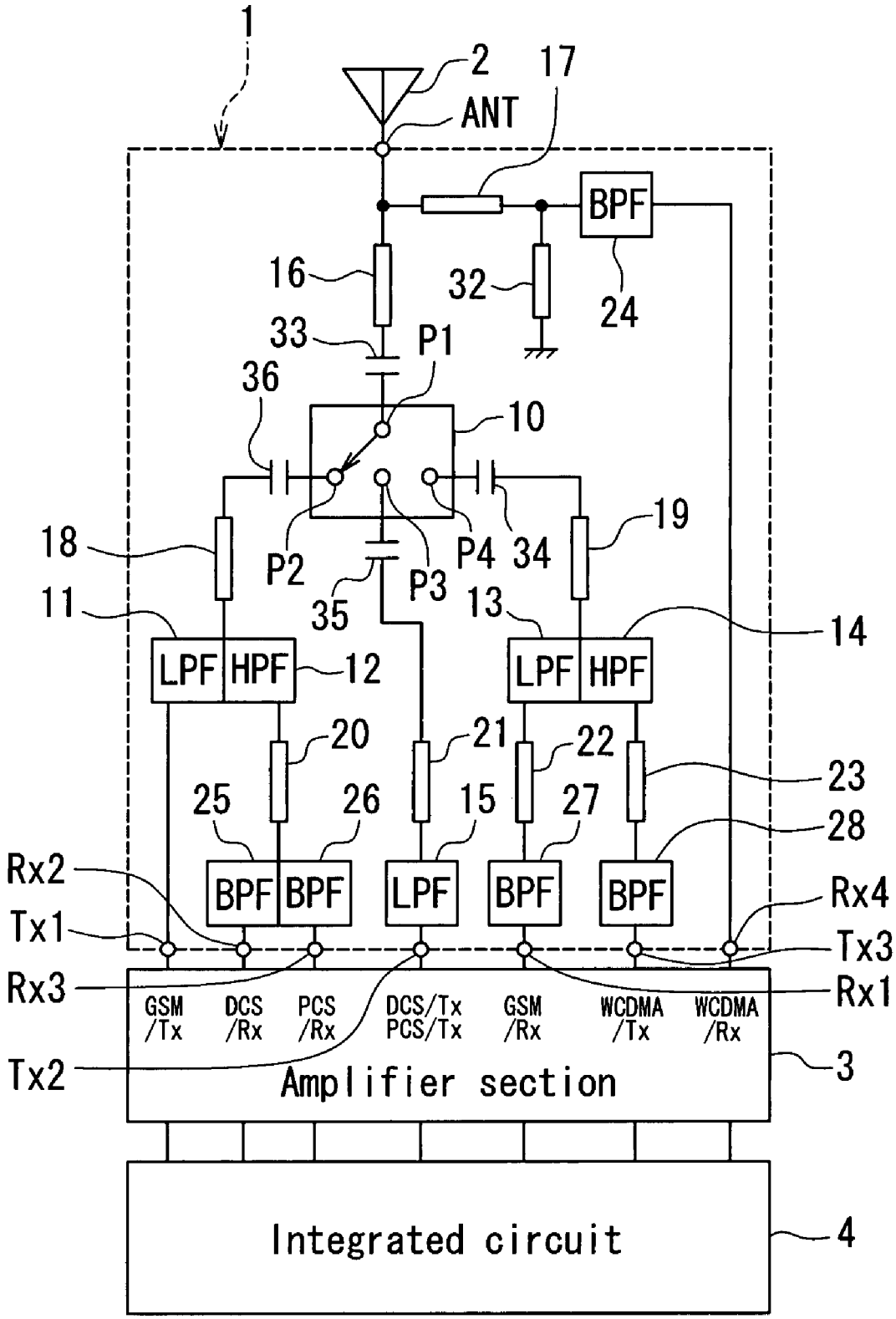
FIG. 1 is a block diagram illustrating an example of circuit configuration of a high frequency circuit of a cellular phone including a high frequency module of a first embodiment of the invention.

Preferred embodiments of the invention will now be described in detail with reference to the accompanying drawings. Reference is now made to FIG. 1 to describe an example of a high frequency circuit of a cellular phone including a high frequency module of a first embodiment of the invention. FIG. 1 is a block diagram illustrating the circuit configuration of this example of high frequency circuit. This high frequency circuit processes WCDMA signals and signals of three time division multiple access systems, that is, GSM signals, DCS signals and PCS signals.

The frequency band of GSM transmission signals is 880 to 915 MHz. The frequency band of GSM reception signals is 925 to 960 MHz. The frequency band of DCS transmission signals is 1710 to 1785 MHz. The frequency band of DCS reception signals is 1805 to 1880 MHz. The frequency band of PCS transmission signals is 1850 to 1910 MHz. The frequency band of PCS reception signals is 1930 to 1990 MHz. The frequency band of WCDMA transmission signals is 1920 to 1980 MHz. The frequency band of WCDMA reception signals is 2110 to 2170 MHz.

The high frequency circuit of FIG. 1 incorporates the high frequency module 1 of the embodiment. The high frequency module 1 incorporates: an antenna terminal ANT; four reception signal terminals Rx1, Rx2, Rx3 and Rx4; and three transmission signal terminals Tx1, Tx2 and Tx3.

The reception signal terminal Rx1 outputs GSM reception signals GSM/Rx. The reception signal terminal Rx2 outputs DCS reception signals DCS/Rx. The reception signal terminal Rx3 outputs PCS reception signals PCS/Rx. The reception signal terminal Rx4 outputs WCDMA reception signals WCDMA/Rx. The transmission signal terminal Tx1 receives GSM transmission signals GSM/Tx. The transmission signal terminal Tx2 receives DCS transmission signals DCS/Tx and PCS transmission signals PCS/Tx. The transmission signal terminal Tx3 receives WCDMA transmission signals WCDMA/Tx.

The high frequency circuit further incorporates: an antenna 2 connected to the antenna terminal ANT; an amplifier section 3 connected to all the reception signal terminals and all the transmission signal terminals of the high frequency module 1; and an integrated circuit 4 connected to the amplifier section 3. The integrated circuit 4 is a circuit for mainly performing modulation and demodulation of signals. The amplifier section 3 includes components such as a low-noise amplifier for amplifying reception signals outputted from the high frequency module 1 and sending the signals to the integrated circuit 4, and a power amplifier for amplifying transmission signals outputted from the integrated circuit 4 and sending the signals to the high frequency module 1.

The high frequency module 1 further incorporates a high frequency switch 10, three low-pass filters (LPFs) 11, 13 and 15, two high-pass filters (HPFs). 12 and 14, and five BPFs 24, 25, 26, 27 and 28.

The high frequency switch 10 has four ports P1 to P4. The high frequency switch 10 selectively connects the port P1 to one of the ports P2 to P4 depending on the state of a control signal received at a plurality of control terminals (not shown) provided in the high frequency module 1.

The high frequency module 1 further incorporates: a phase line 16 having an end connected to the antenna terminal ANT; and a capacitor 33 provided between the other end of the phase line 16 and the port P1 of the high frequency switch 10.

The high frequency module 1 further incorporates: a phase line 17 having an end connected to the antenna terminal ANT and the other end connected to the input of the BPF 24; and an inductor 32 having an end connected to the other end of the phase line 17 and having the other end grounded. The output of the BPF 24 is connected to the reception signal terminal Rx4.

The high frequency module 1 further incorporates: a capacitor 36 having an end connected to the port P2 of the high frequency switch 10; and a phase line 18 having an end connected to the other end of the capacitor 36. The other end of the phase line 18 is connected to the output of the LPF 11 and the input of the HPF 12. The input of the LPF 11 is connected to the transmission signal terminal Tx1.

The high frequency module 1 further incorporates a phase line 20 having an end connected to the output of the HPF 12. The other end of the phase line 20 is connected to the input of each of the BPFs 25 and 26. The output of the BPF 25 is connected to the reception signal terminal Rx2. The output of the BPF 26 is connected to the reception signal terminal Rx3.

The high frequency module 1 further incorporates: a capacitor 35 having an end connected to the port P3 of the high frequency switch 10; and a phase line 21 having an end connected to the other end of the capacitor 35. The other end of the phase line 21 is connected to the output of the LPF 15. The input of the LPF 15 is connected to the transmission signal terminal Tx2.

The high frequency module 1 further incorporates: a capacitor 34 having an end connected to the port P4 of the high frequency switch 10; and a phase line 19 having an end connected to the other end of the capacitor 34. The other end of the phase line 19 is connected to the input of the LPF 13 and the output of the HPF 14.

The high frequency module 1 further incorporates: a phase line 22 having an end connected to the output of the LPF 13; and a phase line 23 having an end connected to the input of the HPF 14. The other end of the phase line 22 is connected to the input of the BPF 27. The output of the BPF 27 is connected to the reception signal terminal Rx1. The other end of the phase line 23 is connected to the output of the BPF 28. The input of the BPF 28 is connected to the transmission signal terminal Tx3.

The BPF 24 is formed using a band-pass filter element 40 of the embodiment. Each of the BPFs 25 to 28 is formed using a surface acoustic wave element, for example. The high frequency switch 10 is formed using a field-effect transistor made of a GaAs compound semiconductor, for example.

The operation of the high frequency module 1 and the high frequency circuit of FIG. 1 will now be described. In the high frequency module 1, the BPF 24 selectively allows WCDMA reception signals to pass. The BPF 24 is connected to the antenna 2 at all times. Therefore, the high frequency circuit is in a state of being capable of receiving WCDMA reception signals at all times. WCDMA reception signals received at the antenna 2 pass through the antenna terminal ANT, the phase line 17 and the BPF 24, and are outputted from the reception signal terminal Rx4. The phase lines 16 and 17 and the inductor 32 adjust the impedance of each of the path from the antenna 2 to the BPF 24 and the path from the antenna 2 to the high frequency switch 10, and thereby separate WCDMA reception signals from other signals.

With regard to signals other than WCDMA reception signals, transmission or reception is allowed in response to the state of the high frequency switch 10, as described below. The state of the high frequency switch 10 is switched in response to the state of a control signal received at the plurality of control terminals not shown. The capacitors 33 to 36 are provided to block the passage of direct current components generated by control signals.

In the state in which the port P1 is connected to the port P2, transmission of GSM transmission signals, reception of DCS reception signals, or reception of PCS reception signals is allowed. In this state, a GSM transmission signal received at the transmission signal terminal Tx1 passes through the LPF 11, the phase line 18, the capacitor 36, the high frequency switch 10, the capacitor 33, the phase line 16, and the antenna terminal ANT in this order, and is supplied to the antenna 2. Furthermore, in this state, a DCS reception signal received at the antenna 2 passes through the antenna terminal ANT, the phase line 16, the capacitor 33, the high frequency switch 10, the capacitor 36, the phase line 18, the HPF 12, the phase line 20, and the BPF 25 in this order, and is outputted from the reception signal terminal Rx2. Furthermore, in this state, a PCS reception signal received at the antenna 2 passes through the antenna terminal ANT, the phase line 16, the capacitor 33, the high frequency switch 10, the capacitor 36, the phase line 18, the HPF 12, the phase line 20, and the BPF 26 in this order, and is outputted from the reception signal terminal Rx3.

In the state in which the port P1 is connected to the port P3, a DCS transmission signal or a PCS transmission signal received at the transmission signal terminal Tx2 passes through the LPF 15, the phase line 21, the capacitor 35, the high frequency switch 10, the capacitor 33, the phase line 16, and the antenna terminal ANT in this order, and is supplied to the antenna 2. The LPF 15 rejects harmonic components contained in DCS and PCS transmission signals.

In the state in which the port P1 is connected to the port P4, reception of GSM reception signals or transmission of WCDMA transmission signals is allowed. In this state, a GSM reception signal received at the antenna 2 passes through the antenna terminal ANT, the phase line 16, the capacitor 33, the high frequency switch 10, the capacitor 34, the phase line 19, the LPF 13, the phase line 22, and the BPF 27 in this order, and is outputted from the reception signal terminal Rx1. In this state, a WCDMA transmission signal received at the transmission signal terminal Tx3 passes through the BPF 28, the phase line 23, the HPF 14, the phase line 19, the capacitor 34, the high frequency switch 10, the capacitor 33, the phase line 16, and the antenna terminal ANT in this order, and is supplied to the antenna 2.

The phase lines 18 to 23 are provided for adjusting the impedances of the respective signal paths on which the phase lines 18 to 23 are located.

Figure 2:
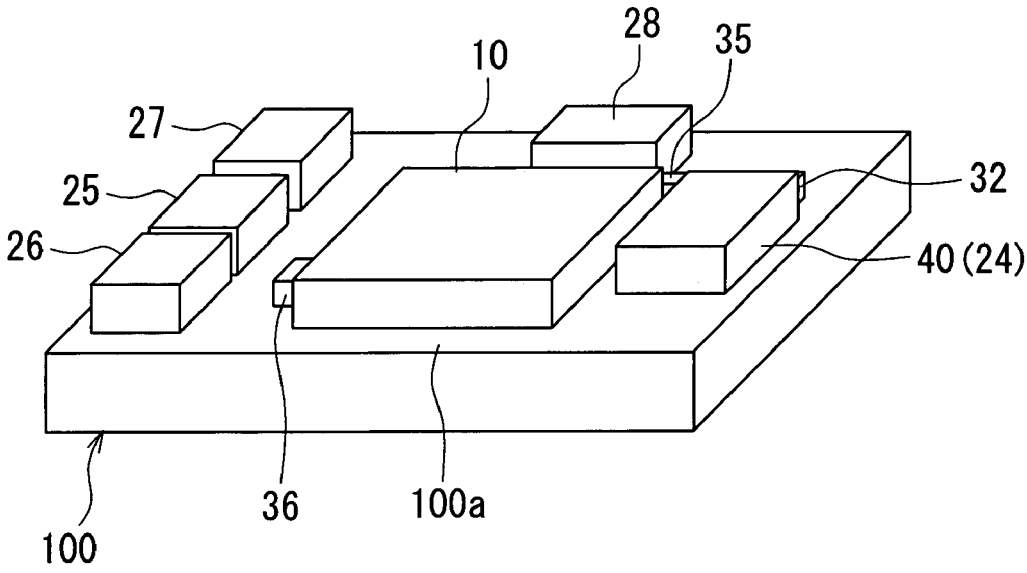
FIG. 2 is a perspective view illustrating an appearance of the high frequency module of the first embodiment of the invention.
Figure 3:
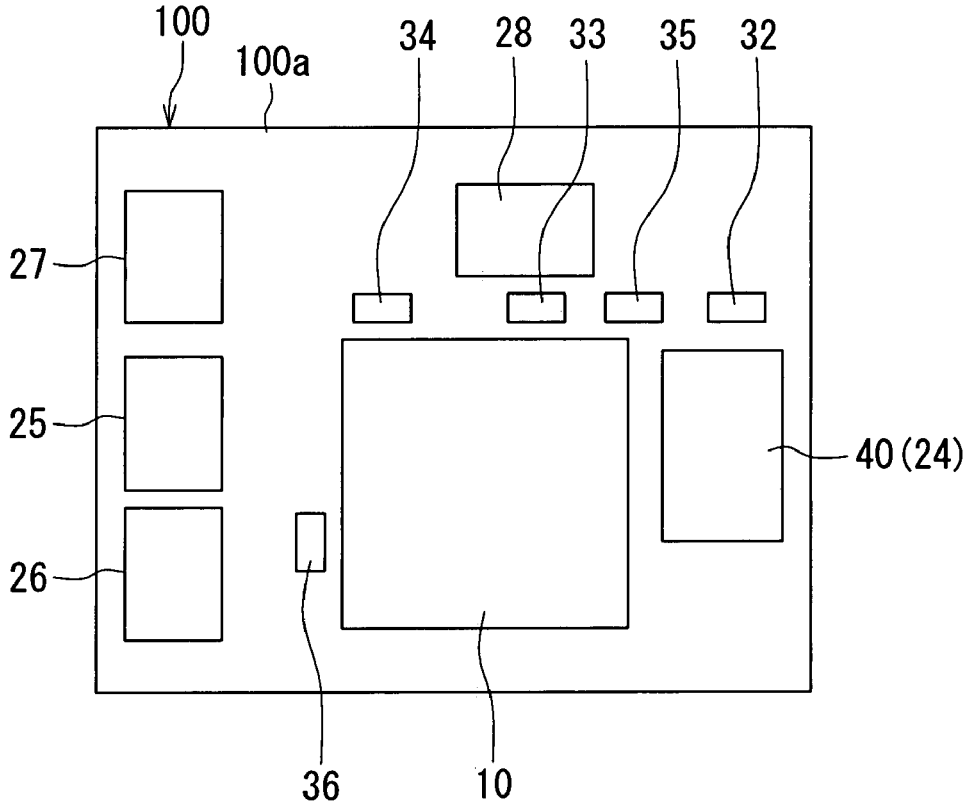
FIG. 3 is a top view of the high frequency module of the first embodiment of the invention.
Figure 4:
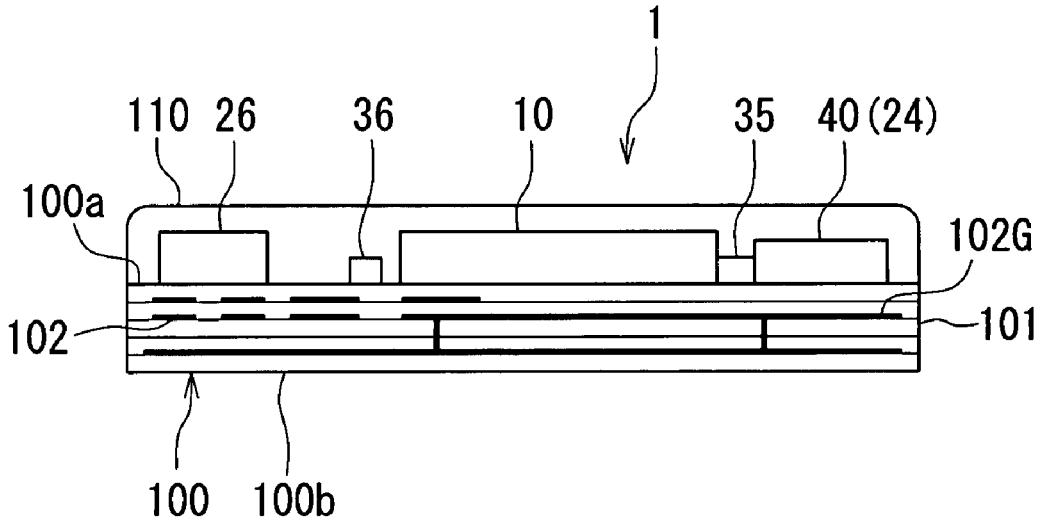
FIG. 4 is a cross-sectional view of the high frequency module of the first embodiment of the invention.

Reference is now made to FIG. 2 to FIG. 4 to describe the structure of the high frequency module 1. FIG. 2 is a perspective view illustrating an appearance of the high frequency module 1. FIG. 3 is a top view of the high frequency module 1. FIG. 4 is a cross-sectional view of the high frequency module 1. As shown in FIG. 2 to FIG. 4, the high frequency module 1 incorporates a layered substrate 100 for integrating the components of the high frequency module 1. As shown in FIG. 4, the layered substrate 100 includes a plurality of intra-substrate dielectric layers 101 and a plurality of intra-substrate conductor layers 102 that are alternately stacked. In FIG. 4 the cross section of the layered substrate 100 is illustrated in a simplified manner. The layered substrate 100 has: a top surface 100*a* and a bottom surface 100*b* located at both sides of the layered substrate 200, the sides being opposed to each other in the direction in which the layers are stacked; and four side surfaces that couple the top surface 100*a* and the bottom surface 100*b* to each other, and the layered substrate 100 is rectangular-solid-shaped.

The circuits of the high frequency module 1 are formed using the intra-substrate dielectric layers 101 and the intra-substrate conductor layers 102, and elements mounted on the top surface 100*a* of the layered substrate 100. At least the band-pass filter element 40 constituting the BPF 24 is mounted on the top surface 100*a*. The top surface 100*a* corresponds to the mounting surface of the invention. Here is given an example in which the high frequency switch 10, the BPFs 25 to 28, the inductor 32, and the capacitors 33 to 36 are mounted on the top surface 100*a*, in addition to the band-pass filter element 40. The layered substrate 100 is a multilayer substrate of low-temperature co-fired ceramic, for example.

Although not shown, the terminals ANT, Rx1 to Rx4, Tx1 to Tx3, and a plurality of control terminals and a plurality of ground terminals are disposed on the bottom surface 100*b* of the layered substrate 100.

As shown in FIG. 4, the layered substrate 100 includes a conductor layer 102G for grounding, as one of the intra-substrate conductor layers 102. The conductor layer 102G is to be connected to the ground and is located to be opposed to the band-pass filter element 40 with the top surface 100*a* disposed in between.

The high frequency module 1 incorporates a metallic casing 110 that is to be connected to the ground and that is disposed to cover the elements mounted on the top surface 100*a* of the layered substrate 100. In FIG. 2 and FIG. 3 the casing 110 is omitted.

Figure 5:
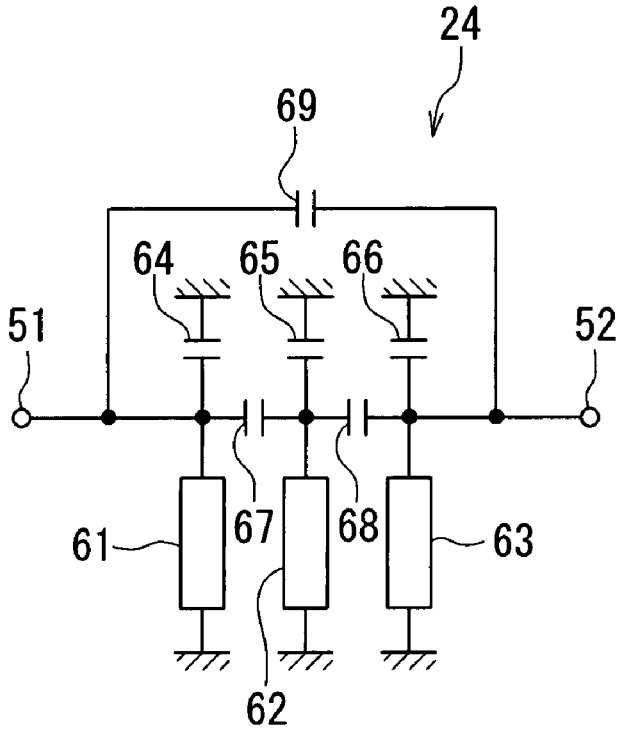
FIG. 5 is a schematic diagram illustrating the circuit configuration of a band-pass filter formed using a band-pass filter element of the first embodiment of the invention.

Reference is now made to FIG. 5 to describe the circuit configuration of the BPF 24. As shown in FIG. 5, the BPF 24 incorporates an input terminal 51, an output terminal 52, and three resonators 61, 62 and 63. The BPF 24 further incorporates: a capacitor 64 provided between one of ends of the resonator 61 and the ground; a capacitor 65 provided between one of ends of the resonator 62 and the ground; a capacitor 66 provided between one of ends of the resonator 63 and the ground; a capacitor 67 provided between the one of the ends of the resonator 61 and the one of the ends of the resonator 62; a capacitor 68 provided between the one of the ends of the resonator 62 and the one of the ends of the resonator 63; and a capacitor 69 provided between the one of the ends of the resonator 61 and the one of the ends of the resonator 63. The input terminal 51 is connected to the one of the ends of the resonator 61. The output terminal 52 is connected to the one of the ends of the resonator 63. The other of the ends of each of the resonators 61, 62 and 63 is connected to the ground.

Figure 6A:
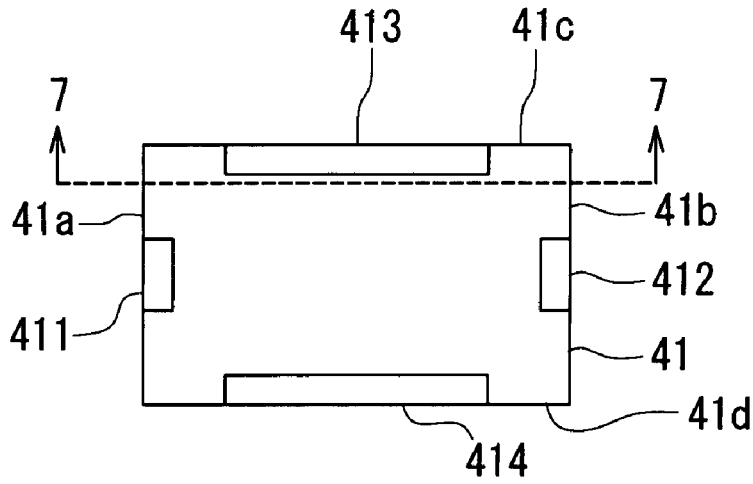
FIG. 6A to FIG. 6E are views for illustrating the configuration of the band-pass filter element of the first embodiment of the invention.
Figure 6B:
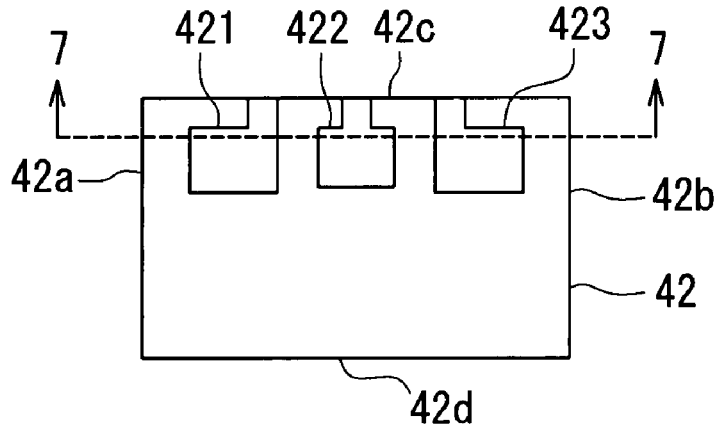
Figure 6C:
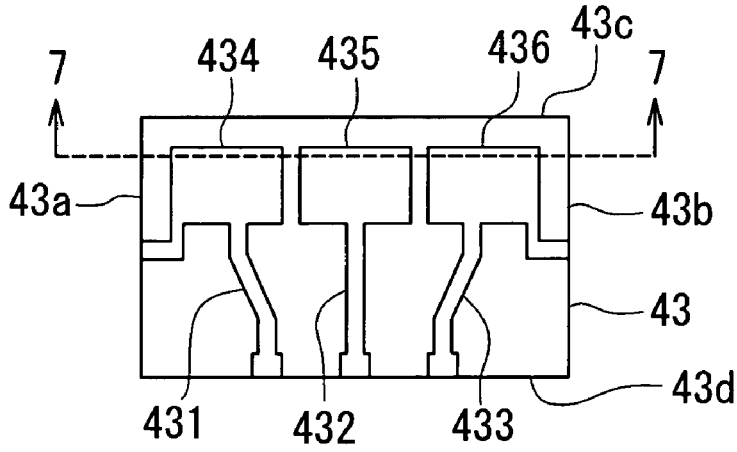
Figure 6D:
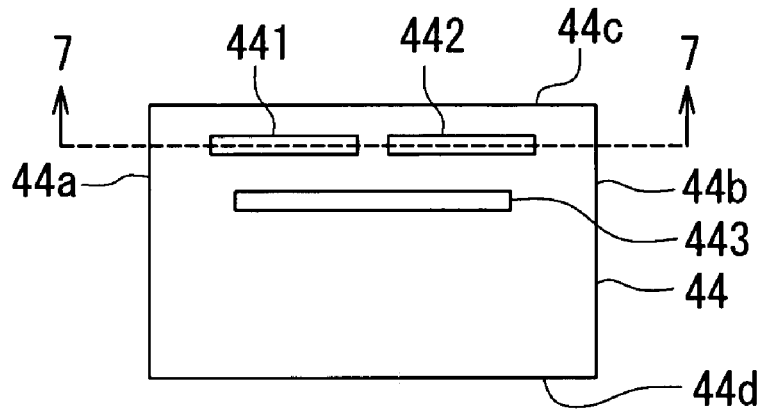
Figure 6E:
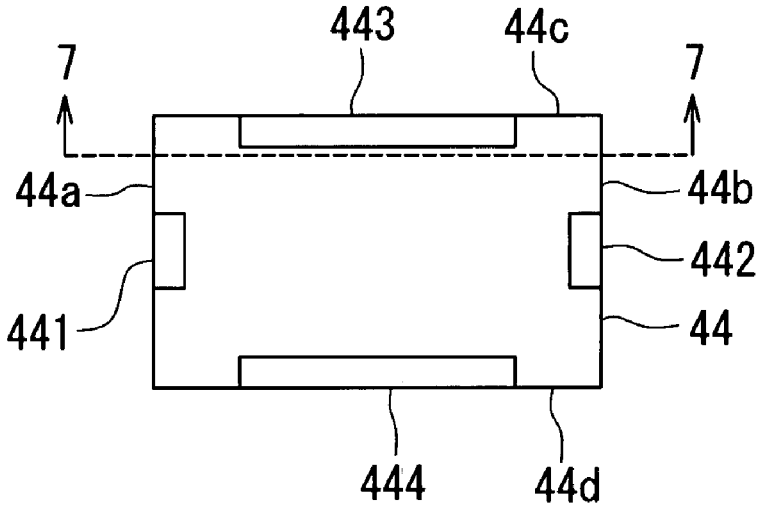
Figure 7:
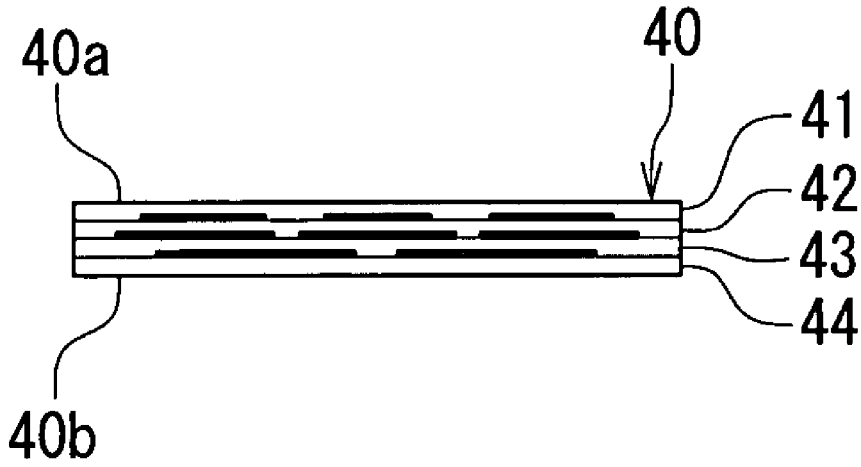
FIG. 7 is a cross-sectional view of the band-pass filter element of the first embodiment of the invention.

Reference is now made to FIG. 6A to FIG. 6E and FIG. 7 to describe the detailed configuration of the band-pass filter element 40 constituting the BPF 24. FIG. 6A to FIG. 6E are views for illustrating the configuration of the band-pass filter element 40. FIG. 7 is a cross-sectional view illustrating the cross section of the band-pass filter element 40 taken along line 7-7 of FIG. 6A to FIG. 6E.

As shown in FIG. 7, the band-pass filter element 40 includes a plurality of conductor layers for band-pass filter and a plurality of dielectric layers 41 to 44 for band-pass filter that are stacked and that implement the function of the BPF 24. The band-pass filter element 40 has: a top surface 40*a* and a bottom surface 40*b* located at both sides opposed to each other in the direction in which the layers are stacked; and four side surfaces that couple the top surface 40*a* and the bottom surface 40*b* to each other, and the band-pass filter element 40 is rectangular-solid-shaped.

FIG. 6A to FIG. 6D respectively illustrate top surfaces of the first to fourth dielectric layers from the top of the band-pass filter element 40. FIG. 6E illustrates the fourth dielectric layer and a conductor layer therebelow seen from above.

As shown in FIG. 6A, the first dielectric layer 41 has four side surfaces 41*a* to 41*d*. The top surface of the dielectric layer 41 has four sides corresponding to the four side surfaces 41*a* to 41*d*. On the top surface of the dielectric layer 41, there are formed a conductor layer 411 for input terminal, a conductor layer 412 for output terminal, and conductor layers 413 and 414 for grounding. The conductor layer 411 touches the side corresponding to the side surface 41*a*. The conductor layer 412 touches the side corresponding to the side surface 41*b*. The conductor layer 413 touches the side corresponding to the side surface 41*c*. The conductor layer 414 touches the side corresponding to the side surface 41*d*.

As shown in FIG. 6B, the second dielectric layer 42 has four side surfaces 42*a* to 42*d*. The top surface of the dielectric layer 42 has four sides corresponding to the four side surfaces 42*a* to 42*d*. On the top surface of the dielectric layer 42, there are formed three conductor layers 421, 422 and 423 for capacitor. Each of the conductor layers 421, 422 and 423 touches the side corresponding to the side surface 42*c*.

As shown in FIG. 6C, the third dielectric layer 43 has four side surfaces 43*a* to 43*d*. The top surface of the dielectric layer 43 has four sides corresponding to the four side surfaces 43*a* to 43*d*. On the top surface of the dielectric layer 43, there are formed three conductor layers 431, 432 and 433 for resonator and three conductor layers 434, 435 and 436 for capacitor. An end of the conductor layer 431 for resonator is connected to the conductor layer 434 for capacitor. An end of the conductor layer 432 for resonator is connected to the conductor layer 435 for capacitor. An end of the conductor layer 433 for resonator is connected to the conductor layer 436 for capacitor. The other end of each of the conductor layers 431 to 433 for resonator touches the side corresponding to the side surface 43*d*. The conductor layer 434 for capacitor touches the side corresponding to the side surface 43*a*. The conductor layer 436 for capacitor touches the side corresponding to the side surface 43*b*. The conductor layers 434, 435 and 436 for capacitor are located to be opposed to the conductor layers 421, 422 and 423, respectively.

The conductor layers 431, 432 and 433 for resonator constitute the resonators 61, 62 and 63 of FIG. 5, respectively. The conductor layers 421 and 434 and the dielectric layer 42 disposed in between constitute the capacitor 64 of FIG. 5. The conductor layers 422 and 435 and the dielectric layer 42 disposed in between constitute the capacitor 65 of FIG. 5. The conductor layers 423 and 436 and the dielectric layer 42 disposed in between constitute the capacitor 66 of FIG. 5.

As shown in FIG. 6D, the fourth dielectric layer 44 has four side surfaces 44*a* to 44*d*. The top surface of the dielectric layer 44 has four sides corresponding to the four side surfaces 44*a* to 44*d*. On the top surface of the dielectric layer 44, there are formed three conductor layers 441, 442 and 443 for capacitor. The conductor layer 441 is located to be opposed to the conductor layers 434 and 435. The conductor layer 442 is located to be opposed to the conductor layers 435 and 436. The conductor layer 443 is located to be opposed to the conductor layers 434, 435 and 436.

The conductor layers 434 and 435, the conductor layer 441, and the dielectric layer 43 disposed in between constitute the capacitor 67 of FIG. 5. The conductor layers 435 and 436, the conductor layer 442, and the dielectric layer 43 disposed in between constitute the capacitor 68 of FIG. 5. The conductor layers 434 and 436, the conductor layer 443, and the dielectric layer 43 disposed in between constitute the capacitor 69 of FIG. 5.

As shown in FIG. 6E, the bottom surface of the fourth dielectric layer 44 has four sides corresponding to the four side surfaces 44*a* to 44*d*. On the bottom surface of the dielectric layer 44, there are formed a conductor layer 441 for input terminal, a conductor layer 442 for output terminal, and conductor layers 443 and 444 for grounding. The conductor layer 441 touches the side corresponding to the side surface 44*a*. The conductor layer 442 touches the side corresponding to the side surface 44*b*. The conductor layer 443 touches the side corresponding to the side surface 44*c*. The conductor layer 444 touches the side corresponding to the side surface 44*d*.

Although not shown, conductor layers are respectively formed on the side surfaces 41*a*, 42*a*, 43*a* and 44*a*, and the conductor layers 411, 434 and 441 are electrically connected to one another through those conductor layers. Similarly, conductor layers are respectively formed on the side surfaces 41*b*, 42*b*, 43*b* and 44*b*, and the conductor layers 412, 436 and 442 are electrically connected to one another through those conductor layers. Conductor layers are respectively formed on the side surfaces 41*c*, 42*c*, 43*c* and 44*c*, and the conductor layers 413, 421 to 423, and 443 are electrically connected to one another through those conductor layers. Conductor layers are respectively formed on the side surfaces 41*d*, 42*d*, 43*d* and 44*d*, and the conductor layers 414, 431 to 433, and 444 are electrically connected to one another through those conductor layers.

The permittivity of each of the dielectric layers 41 to 44 for band-pass filter is higher than that of the intra-substrate dielectric layers 101. To be specific, for example, the relative permittivity of the intra-substrate dielectric layers 101 is 5 to 10 while the relative permittivity of the dielectric layers 41 to 44 is equal to or higher than 20, and preferably 30 to 80.

Each of the conductor layers shown in FIG. 6A to FIG. 6E is a conductor layer for band-pass filter that implements the function of the BPF 24. The band-pass filter element 40 includes no conductor layer that functions as an electromagnetic shield. However, when the band-pass filter element 40 is mounted on the layered substrate 100, the conductor layer 102G for grounding that the layered substrate 100 includes is opposed to the band-pass filter element 40 with the top surface 100*a* located in between, and thereby functions as an electromagnetic shield for the band-pass filter element 40. One of the surfaces of the portion of the conductor layer 102G opposed to the band-pass filter element 40 has an area greater than the area of one of the surfaces of each of the conductor layers that the band-pass filter element 40 includes. Furthermore, when the band-pass filter element 40 is mounted on the layered substrate 100 and covered with the casing 110, the casing 110 is opposed to the band-pass filter element 40 and thereby functions as an electromagnetic shield for the band-pass filter element 40, too.

The resonators 61, 62 and 63 formed using the conductor layers 431, 432 and 433 each have a Q that varies in response to the configuration of conductor layers that are respectively disposed on the top and bottom of the conductor layers 431, 432 and 433 and that are to be connected to the ground. In the embodiment the conductor layer 102G and the casing 110 are the conductor layers that are respectively disposed on the top and bottom of the conductor layers 431, 432 and 433 and that are to be connected to the ground. In the embodiment the band-pass filter element 40 is designed such that a desired characteristic of the BPF 24 is obtained when the band-pass filter element 40 is disposed between the conductor layer 102G and the casing 110. That is, a desired characteristic of the BPF 24 is implemented by the band-pass filter element 40, the conductor layer 102G and the casing 110 in the embodiment.

The conductor layer 102G for grounding may be one that functions only as an electromagnetic shield for the band-pass filter element 40, or may be one that also functions as the ground of the circuit formed using the intra-substrate conductor layers and the intra-substrate dielectric layers in the layered substrate 100. The conductor layer 102G may be the lowest one of the plurality of conductor layers that the layered substrate 100 includes or may be any other one of the conductor layers. If the conductor layer 102G is the lowest one, there is a benefit that it is possible that the distance between the band-pass filter element 40 and the conductor layer 102G is the greatest. If the conductor layer 102G is not the lowest one, there is a benefit that it is possible to dispose another conductor layer for forming the circuit components below the conductor layer 102G in the layered substrate 100.

For example, there is a case in which the high frequency circuit of FIG. 1 is placed in a metallic enclosure and the distance between the enclosure and the band-pass filter element 40 is maintained such that the enclosure will not affect the characteristic of the band-pass filter element 40. In such a case, the metallic enclosure that accommodates the high frequency circuit functions as an electromagnetic shield for the band-pass filter element 40 even though the casing 110 is not provided. As thus described, since there may be cases in which the product including the high frequency module 1 of the embodiment includes a component that functions as the shield in place of the casing 110, it is not absolutely necessary to provide the casing 110.

Figure 8:
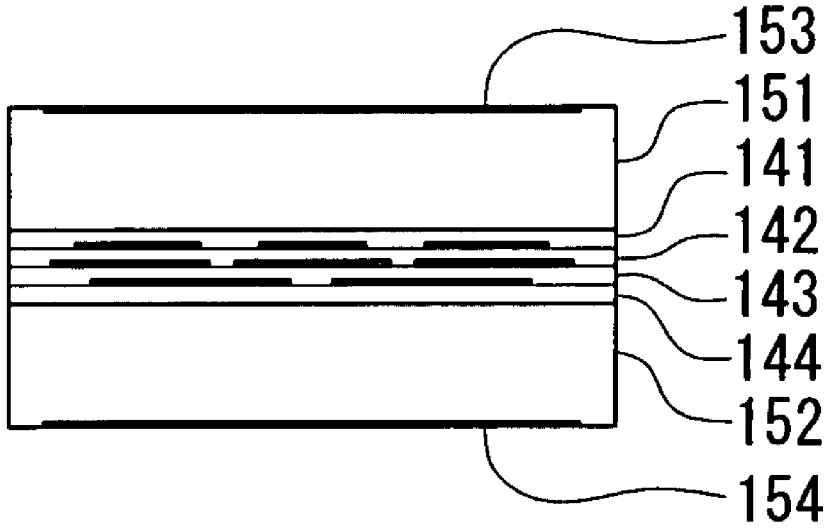
FIG. 8 is a cross-sectional view of a band-pass filter element of a first reference example.

Effects of the band-pass filter element 40 and the high frequency module 1 of the embodiment will now be described, referring to first and second reference examples. FIG. 8 is a cross-sectional view of a band-pass filter element of the first reference example. The band-pass filter element of the first reference example includes dielectric layers 141 to 144. On the respective top surfaces of the dielectric layers 142, 143 and 144, there are formed conductor layers the same as those formed on the top surfaces of the dielectric layers 42, 43 and 44, respectively. There is no conductor layer formed on each of the top surface of the dielectric layer 141 and the bottom surface of the dielectric layer 144. A dielectric layer 151 is disposed on the dielectric layer 141. A dielectric layer 152 is disposed below the dielectric layer 144. A conductor layer 153 for shield is disposed on the top surface of the dielectric layer 151. A conductor layer 154 for shield is disposed on the bottom surface of the dielectric layer 153.

The thickness of each of the dielectric layers 151 and 152 is greater than the thickness of each of the dielectric layers 141 to 144, and is greater than the total thickness of the dielectric layers 141 to 144, for example. The permittivity of each of the dielectric layers 141 to 144 is higher than that of each of the dielectric layers 151 and 152. To be specific, for example, the relative permittivity of each of the dielectric layers 151 and 152 is 5 to 10, and the relative permittivity of each of the dielectric layers 141 to 144 is equal to or higher than 20, and preferably 30 to 80. The band-pass filter element of the first reference example is assumed to implement a characteristic equivalent to that of the BPF 24 implemented by the band-pass filter element 40, the conductor layer 102G for grounding and the casing 110 of the embodiment. Here, a high frequency module implemented by mounting the band-pass filter element of the first reference example on the layered substrate 100 in place of the band-pass filter element 40 of the embodiment is called a high frequency module of the first reference example.

The thickness of the band-pass filter element of the first reference example is much greater than the thickness of the band-pass filter element 40 of the embodiment. Consequently, the thickness of the entire layered structure including the layered substrate 100 and the band-pass filter element of the high frequency module of the first reference example is greater than the thickness of the entire layered structure including the layered substrate 100 and the band-pass filter element 40 of the high frequency module 1 of the embodiment. In the band-pass filter element of the first reference example, if the distance from the conductor layers formed on the dielectric layers 141 to 144 to the conductor layers 153 and 154 for shield is reduced, the Q of the resonators that the band-pass filter element includes is reduced. It is therefore required that each of the dielectric layers 151 and 152 be thick to some extent. According to the first reference example as thus described, the thickness of the high frequency module is great and it is therefore difficult to downsize the high frequency circuit including the high frequency module.

In contrast, since the band-pass filter element 40 of the embodiment includes no conductor layer that functions as an electromagnetic shield, it is possible to make the thickness thereof smaller than that of the band-pass filter element of the first reference example. In addition, in the embodiment, the conductor layer 102G for grounding that the layered substrate 100 includes and the metallic casing 110 function as an electromagnetic shield for the band-pass filter element 40. It is thereby possible to increase the distance between the band-pass filter element 40 and the shield, and thereby increase the Q of the resonators 61 to 63. Because of these features, according to the embodiment, it is possible to reduce the thickness of the high frequency module 1, that is, the thickness of the entire layered structure including the layered substrate 100 and the band-pass filter element 40 while increasing the Q of the resonators 61 to 63. As a result, the embodiment achieves an improvement in Q of the resonators 61 to 63 and a reduction in profile of the high frequency module 1 at the same time, and also allows a reduction in size of the high frequency circuit including the high frequency module 1.

Figure 9:
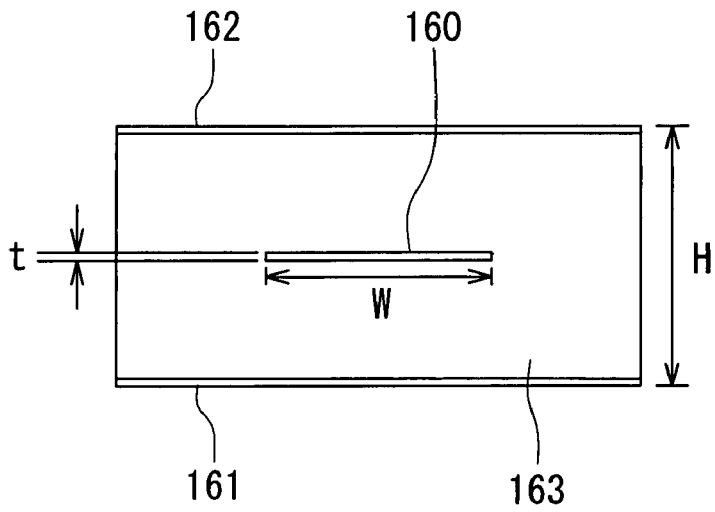
FIG. 9 is a view for illustrating a model used in a simulation performed to examine the relationship between the Q of a resonator and the distance from the resonator to a conductor layer for grounding.
Figure 10:
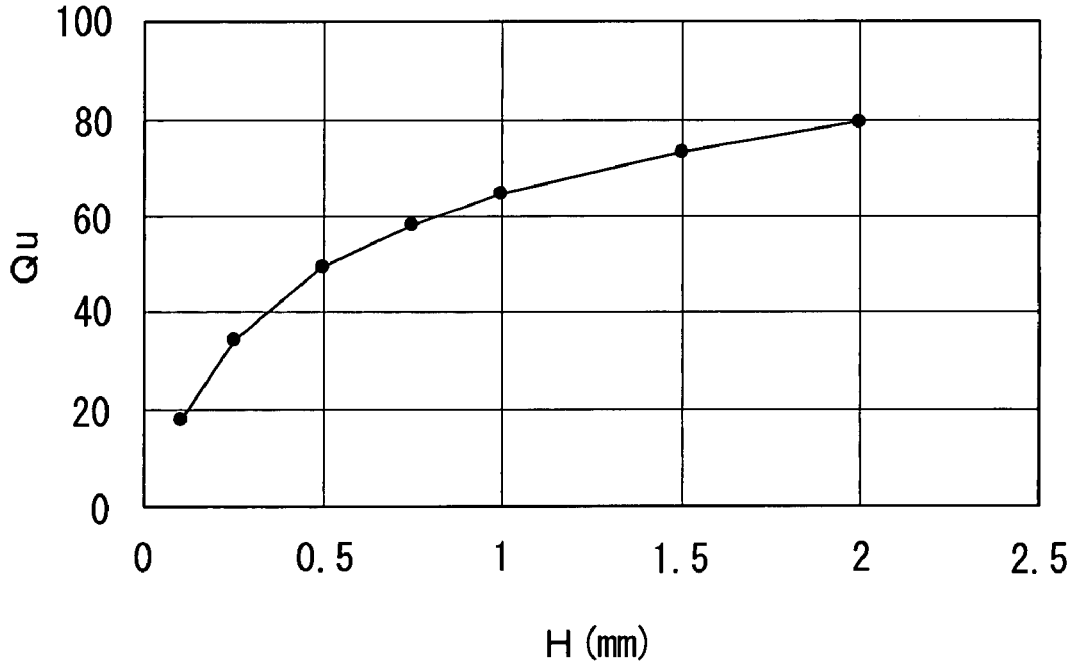
FIG. 10 is a plot showing the results of the simulation.

Reference is now made to FIG. 9 and FIG. 10 to describe the results of a simulation performed to examine the relationship between the Q of a resonator and the distance from the resonator to a conductor layer for grounding. FIG. 9 is a view for illustrating a model used in the simulation. The model incorporates: a strip line 160 as a conductor layer constituting a resonator; a conductor layer 161 for grounding disposed below the strip line 160; a conductor layer 162 for grounding disposed above the strip line 160; and a dielectric layer 163 disposed between the conductor layers 161 and 162. It was predetermined that the width W of the strip line 160 was 0.1 mm, and the thickness t of the strip line 160 was 0.01 mm. Assume that the width of each of the conductor layers 161 and 162 is sufficiently greater than the width W of the strip line 160. The strip line 160 and the conductor layers 161, 162 are located parallel to each other. Here, the distance between the bottom surface of the conductor layer 161 and the top surface of the conductor layer 162 is defined as H (mm), and an unloaded Q of the resonator formed by the strip line 160 is defined as Qu. The relationship between this distance H and Qu was examined in the simulation. FIG. 10 shows the results. As seen from FIG. 10, the smaller the distance H, the smaller is Qu. This indicates that the Q of the resonator decreases as the distance between the resonator and the conductor layer for grounding decreases.

According to the embodiment, since the band-pass filter element 40 is mounted on the layered substrate 100, it is possible to provide the phase line 31 in the layered substrate 100, the phase line 31 adjusting the impedance of each of the path from the antenna 2 to the BPF 24 and the path from the antenna 2 to the high frequency switch 10 and thereby separating WCDMA reception signals from other signals. As a result, it is possible to adjust the characteristic of the high frequency module 1.

Figure 11:
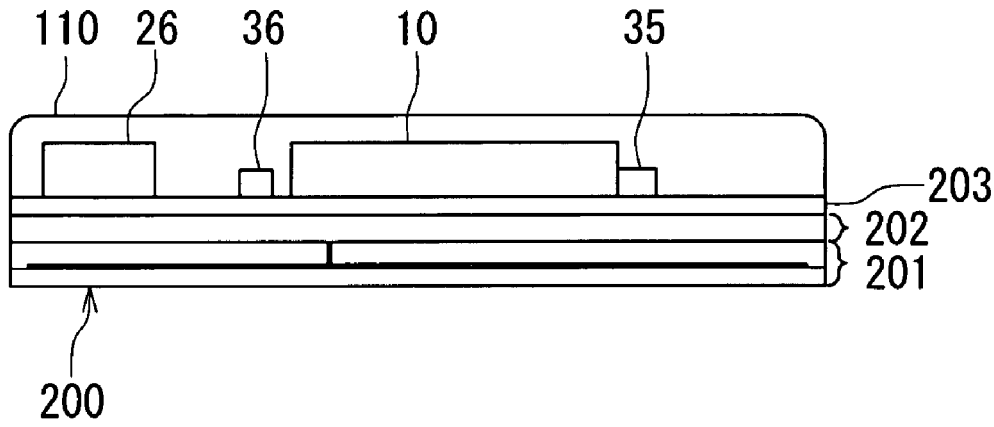
FIG. 11 is a cross-sectional view of a high frequency module of a second reference example.

FIG. 11 is a cross-sectional view of a high frequency module of the second reference example. The high frequency module of the second reference example incorporates a layered substrate 200 in place of the layered substrate 100 of the embodiment. On the top surface of the layered substrate 200, there are mounted elements other than the band-pass filter element 40 among the elements mounted on the top surface of the layered substrate 100 of the embodiment.

The layered substrate 200 includes: a high permittivity portion 202 for implementing the BPF 24; a low permittivity portion 201 disposed below the high permittivity portion 202; and a low permittivity portion 203 disposed on top of the high permittivity portion 202. Each of the portions 201 to 203 includes a plurality of dielectric layers and a plurality of conductor layers alternately stacked. The high permittivity portion 202 includes a plurality of conductor layers for implementing the BPF 24. The permittivity of the dielectric layers that the high permittivity portion 202 includes is higher than that of the dielectric layers that the low permittivity portions 201 and 203 include. To be specific, for example, the relative permittivity of the dielectric layers that the low permittivity portions 201 and 203 include is 5 to 10, and the relative permittivity of the dielectric layers that the high permittivity portion 202 includes is equal to or higher than 20, and preferably 30 to 80.

In the second reference example, as described above, the layered substrate 200 includes the high permittivity portion 202 and the low permittivity portions 201 and 203. As a result, the characteristic of the circuit component implemented by the low permittivity portions 201 and 203 is influenced by the dielectric layers included in the high permittivity portion 202 that have a high permittivity. According to the second reference example, it is therefore difficult to design the layered substrate 200 for implementing a circuit having a desired characteristic. Furthermore, in a case in which the layered substrate 200 is to be formed of a multilayer substrate of low-temperature co-fired ceramic, it is required to stack layers of a plurality of types of dielectric materials having different permittivities and to bake them so as to manufacture the layered substrate 200. In this case, it is difficult to manufacture the layered substrate 200 with precision.

According to the embodiment, in contrast, it is possible to design and manufacture the layered substrate 100 and the band-pass filter element 40 individually, so that it is easy to design and manufacture the layered substrate 100 and the band-pass filter element 40.

Second Embodiment

Figure 12:
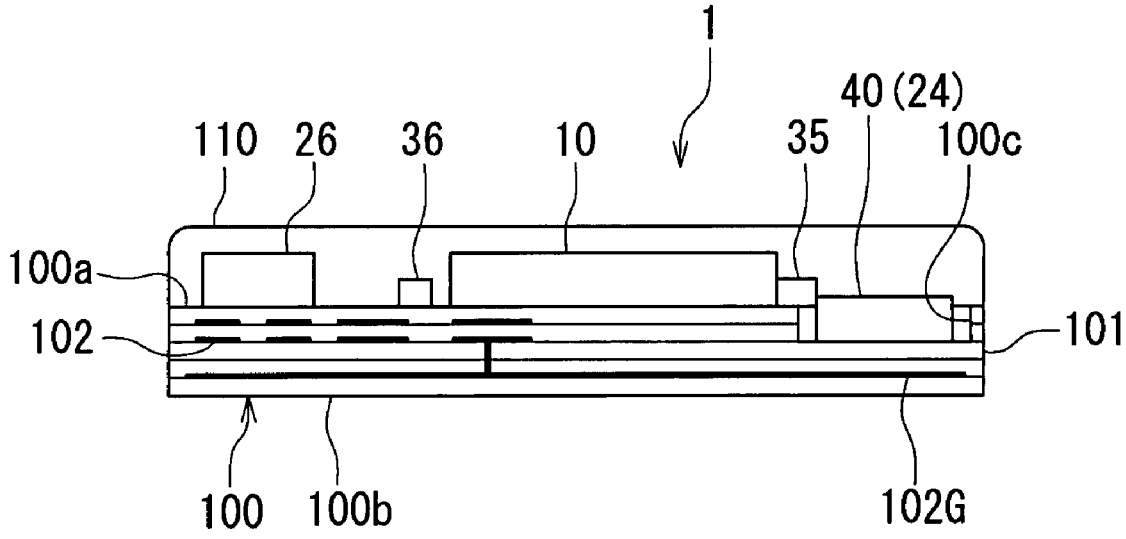
FIG. 12 is a cross-sectional view of a high frequency module of a second embodiment of the invention.

Reference is now made to FIG. 12 to describe a high frequency module and the band-pass filter element 40 of a second embodiment of the invention. FIG. 12 is a cross-sectional view of the high frequency module of the second embodiment. In the high frequency module 1 of the second embodiment, the top surface 100*a* of the layered substrate 100 includes a recessed portion 100*c*. The band-pass filter element 40 is placed in the recessed portion 100*c*. The layered substrate 100 includes, as one of the intra-substrate conductor layers 102, the conductor layer 102G for grounding that is to be connected to the ground and that is located to be opposed to the band-pass filter element 40 with the bottom surface of the recessed portion 100*c* located in between, the recessed portion 100*c* being part of the top surface 100*a*. The conductor layer 102G is opposed to the band-pass filter element 40 with the bottom surface of the recessed portion 100*c* located in between, the recessed portion 100*c* being part of the top surface 100*a*, and thereby functions as an electromagnetic shield for the band-pass filter element 40.

According to the second embodiment, it is possible to make the distance between the band-pass filter element 40 and the casing 110 greater than that of the first embodiment. When the layered substrate 100 has a flat top surface 100*a* and the band-pass filter element 40 is mounted on such a top surface 100*a* as in the first embodiment, there may be cases in which a sufficient distance cannot be secured between the band-pass filter element 40 and the casing 110 and consequently the Q of the resonators 61 to 63 is decreased. In contrast, the second embodiment makes it possible to make the distance between the band-pass filter element 40 and the casing 110 sufficiently great and to thereby improve the Q of the resonators 61 to 63. In the second embodiment, it suffices that the conductor layer 102G in the layered substrate 100 is disposed at such a position that the distance between the band-pass filter element 40 and the casing 110 can be sufficiently great.

According to the second embodiment, it is possible to design the depth of the recessed portion 100*c* and the position of the conductor layer 102G as desired, so that it is easy to adjust the characteristic of the BPF 24. The remainder of configuration, function and effects of the second embodiment are similar to those of the first embodiment.

The present invention is not limited to the foregoing embodiments but may be practiced in still other ways. For example, in the invention, the permittivity of the dielectric layers 41 to 44 for band-pass filter may be equal to that of the intra-substrate dielectric layers 101. It is possible to obtain the foregoing effects of each of the embodiments in this case, too.

The invention is applicable not only to high frequency modules included in high frequency circuits incorporated in cellular phones but also to high frequency modules in general incorporating band-pass filters.

Obviously many modifications and variations of the present invention are possible in the light of the above teachings. It is therefore to be understood that within the scope of the appended claims the invention may be practiced otherwise than as specifically described.

What is claimed is:

1. A high frequency module comprising a layered substrate and a band-pass filter element mounted on the layered substrate, wherein:

the layered substrate incorporates: a mounting surface on which the band-pass filter element is mounted; a plurality of intra-substrate conductor layers; and a plurality of intra-substrate dielectric layers, the intra-substrate dielectric layers and the intra-substrate conductor layers being alternately stacked;

the band-pass filter element includes conductor layers for band-pass filter and dielectric layers for band-pass filter that are stacked and that implement a function of a band-pass filter, but the band-pass filter element does not include any conductor layer that functions as an electromagnetic shield;

the intra-substrate conductor layers include a conductor layer that is located to be opposed to the band-pass filter element with the mounting surface disposed in between and that functions as an electromagnetic shield for the band-pass filter element;

the dielectric layers for band-pass filter have a permittivity higher than that of the intra-substrate dielectric layers; and the layered substrate includes a circuit formed using the intra-substrate conductor layers, and the conductor layer that functions as the electromagnetic shield also functions as a ground of the circuit.

2. A high frequency module comprising a layered substrate and a band-pass filter element mounted on the layered substrate, wherein:

the layered substrate incorporates: a mounting surface on which the band-pass filter element is mounted; a plurality of intra-substrate conductor layers; and a plurality of intra-substrate dielectric layers, the intra-substrate dielectric layers and the intra-substrate conductor layers being alternately stacked;

the band-pass filter element includes conductor layers for band-pass filter and dielectric layers for band-pass filter that are stacked and that implement a function of a band-pass filter, but the band-pass filter element does not include any conductor layer that functions as an electromagnetic shield;

the intra-substrate conductor layers include a conductor layer that is located to be opposed to the band-pass filter element with the mounting surface disposed in between and that functions as an electromagnetic shield for the band-pass filter element;

the dielectric layers for band-pass filter have a permittivity higher than that of the intra-substrate dielectric layers; and the mounting surface includes a recessed portion, and the band-pass filter element is placed in the recessed portion.

* * * * *